US007699669B2

(12) United States Patent
Sweeney et al.

(10) Patent No.: US 7,699,669 B2
(45) Date of Patent: Apr. 20, 2010

(54) SCREW ASSEMBLY FOR ELECTRICAL CONNECTORS

(75) Inventors: Thomas M. Sweeney, Cincinnati, OH (US); Kevin Jenkins, Milford, OH (US)

(73) Assignee: Ilsco Corporation, Cincinnati, OH (US)

( * ) Notice: Subject to any disclaimer, the term of this patent is extended or adjusted under 35 U.S.C. 154(b) by 128 days.

(21) Appl. No.: 11/844,547

(22) Filed: Aug. 24, 2007

(65) Prior Publication Data

US 2009/0053940 A1 Feb. 26, 2009

(51) Int. Cl.
*H01R 11/03* (2006.01)

(52) U.S. Cl. ..... 439/791

(58) Field of Classification Search ..... 439/812, 439/791, 813, 814, 797–798, 811, 810, 431; 24/115 N; 403/362

See application file for complete search history.

(56) References Cited

U.S. PATENT DOCUMENTS

| | | | | |
|---|---|---|---|---|
| 1,266,441 | A | | 5/1918 | Finkelstein |
| 1,336,290 | A | | 4/1920 | Finkelstein |
| 2,068,152 | A | | 1/1937 | Rowe |
| 2,193,202 | A | | 3/1940 | Millermaster |
| 2,201,674 | A | | 5/1940 | Rowe et al. |
| 3,015,084 | A | | 12/1961 | Gribble |
| 3,125,397 | A | | 3/1964 | McGrath |
| 3,339,174 | A | | 8/1967 | Walter et al. |
| 3,350,677 | A | | 10/1967 | Daum |
| 3,426,319 | A | | 2/1969 | Downs et al. |
| 3,650,025 | A | | 3/1972 | McLaughlin et al. |
| 3,737,839 | A | * | 6/1973 | Marechal ..... 24/115 R |
| 3,836,941 | A | | 9/1974 | Izraeli |
| 3,864,005 | A | | 2/1975 | Klein |
| 4,059,335 | A | * | 11/1977 | Simon ..... 439/813 |
| 4,072,393 | A | | 2/1978 | McDermott et al. |
| 5,690,515 | A | | 11/1997 | Cipolla |
| 6,080,024 | A | | 6/2000 | Miller et al. |
| 6,186,839 | B1 | | 2/2001 | Storey et al. |
| 6,210,239 | B1 | | 4/2001 | Harting et al. |
| 6,338,658 | B1 | | 1/2002 | Sweeney |
| 6,764,354 | B2 | | 7/2004 | Kaine et al. |
| 7,090,532 | B1 | | 8/2006 | Kaine |

* cited by examiner

*Primary Examiner*—Edwin A. Leon
(74) *Attorney, Agent, or Firm*—Wood, Herron & Evans, LLP

(57) ABSTRACT

A screw assembly for use with an electrical connector securing a conductor includes a threaded body configured to be releasably coupled to a coupling portion of the connector. A contacting structure includes a plate spaced from the threaded body and has a flat contacting surface configured for contacting the conductor. The plate is coupled to the threaded body. The plate is rotatable relative to the threaded body when the threaded body is coupled to the coupling portion of the connector. The plate is restricted from movement away from said threaded body when the threaded body is not coupled to the coupling portion of the connector. A spacer may be positioned between the plate and the threaded body and is configured to urge the plate away from the threaded body.

20 Claims, 5 Drawing Sheets

SCREW ASSEMBLY FOR ELECTRICAL CONNECTORS

FIELD OF THE INVENTION

This invention relates to electrical connectors and, more particularly, to wire-contacting screw assemblies for use with such connectors.

BACKGROUND OF THE INVENTION

Various types of electrical connectors are used for connecting electrical conductors to one another or to the terminals of electrical devices. Conventional connectors receive a conductor within a channel or the like and then receive a screw. The screw is then tightened against the conductor so that it is held in physical contact with the connector.

Known conductors are made of a soft material such as copper or aluminum and may further be defined by a series of individual bare strands. Conventional connectors and, more particularly, screws used with such connectors, may have a tendency to damage the conductors. Pointed, angled or tapered screw configurations often dent or damage the strands.

Connections between connectors and conductors may also involve different materials. For example, the screw of a connector may be made of one material while a conductor may be made of another. Different materials may have different rates of expansion and contraction. Accordingly, the life span of the connection and/or the temperatures to which the connector and conductor may be subject to lead to relative movement between the connector and the conductor. This movement causes loosening of the connection, which leads to an inadequate electrical connection between the parts involved.

Loose connections may also arise from different degrees of elasticity of the parts involved. More particularly, one element may exhibit one degree of elastic deformation during engagement of the screw with the conductor, while another material will exhibit a different degree of elastic deformation. These different degrees of elastic deformation lead to different degrees of material recovery, which may result in loose connections.

Known connectors may be used in areas subject to relatively high degrees of vibration. In such types of environment, vibration may similarly lead to loose connections between the conductor and the connector. More particularly, vibration may lead to movement of the screw relative to the connector. This relative movement, in turn, loosens the physical contact between them. As a way to compensate for this observed loosened connection, a user often performs periodic maintenance to retorque the connection. Without such maintenance, the loose connection may eventually result, for example, in elevated operating temperatures in the connection, which in turn may result in a failed connection.

Therefore, it is desirable to have a connector and a corresponding screw that address the drawbacks of conventional connectors and corresponding conventional screws.

SUMMARY OF THE INVENTION

These and other problems in the prior art have been addressed with this invention. In one embodiment according to this invention, a screw assembly for use with an electrical connector secures a conductor and includes a threaded body configured to be coupled to a coupling portion of the connector. A plate is spaced from and coupled to the threaded body and has a flat contacting surface configured for contacting the conductor. The plate is coupled to the threaded body to enable rotation of the plate relative to the threaded body. The plate is restricted from movement away from the threaded body when the threaded body is not coupled to the coupling portion of the connector. A spacer is positioned between the plate and the threaded body and configured to urge the plate away from the threaded body. The spacer may alternatively or additionally be configured to deflect toward the threaded body when the plate contacts the conductor. The plate may be rotatable relative to the spacer. In specific embodiments, the plate is configured for movement toward the threaded body. Coupling of the plate to the threaded body may define a unitary structure configured to be releasably coupled to the connector.

In another embodiment, an electrical connecting assembly for securing a conductor includes a connector body configured to receive the conductor. A threaded body and a contacting structure are assembled as a unitary structure. The threaded body is releasably coupled to a coupling portion of the connector body. The contacting structure includes a plate spaced from the threaded body and which has a flat contacting surface configured for contacting the conductor. The plate is coupled to the threaded body such that the plate is rotatable relative to the threaded body when the threaded body is coupled to the coupling portion. The plate is restricted from movement away from the threaded body when the threaded body is not coupled to the coupling portion.

In another embodiment according to this invention, a method of securing a conductor to a connector includes positioning the conductor within the connector. A first portion of a unitary structure is releasably coupled with a coupling portion of the connector. A second portion of the unitary structure engages the conductor. The first and second portions are spaced from one another. The method includes rotating the second portion of the unitary structure relative to the first portion when the first portion contacts the conductor. In a specific embodiment, the method further includes deflecting the second portion toward the first portion when the second portion contacts the conductor.

BRIEF DESCRIPTION OF DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
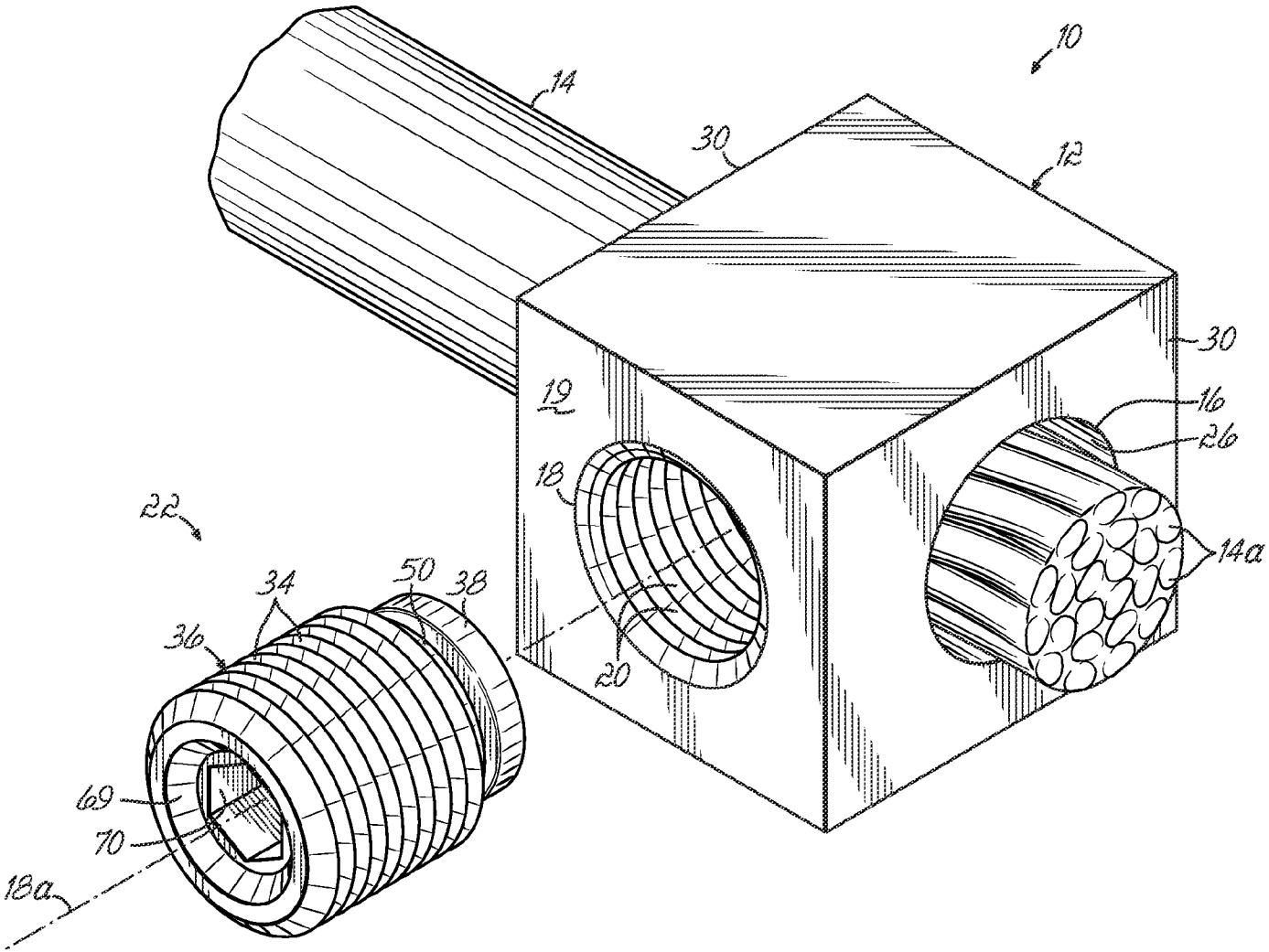
FIG. 1 is a perspective view of a connector and screw assembly in accordance with an embodiment of this invention.
Figure 2:
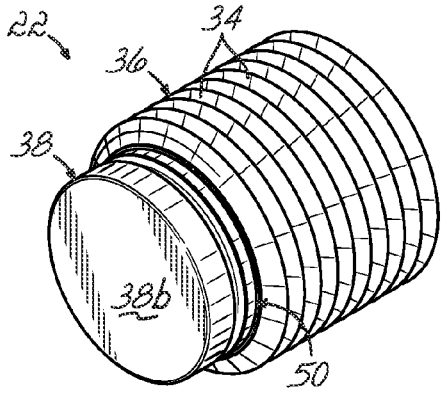
FIG. 2 is a perspective view of the screw assembly of FIG. 1.
Figure 3:
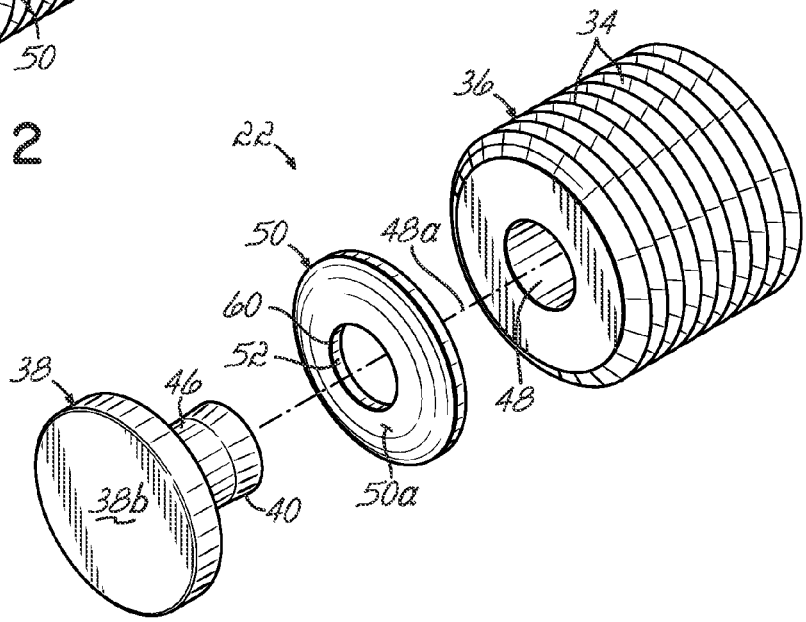
FIG. 3 is a disassembled perspective view of the screw assembly of FIG. 2.
Figure 4:
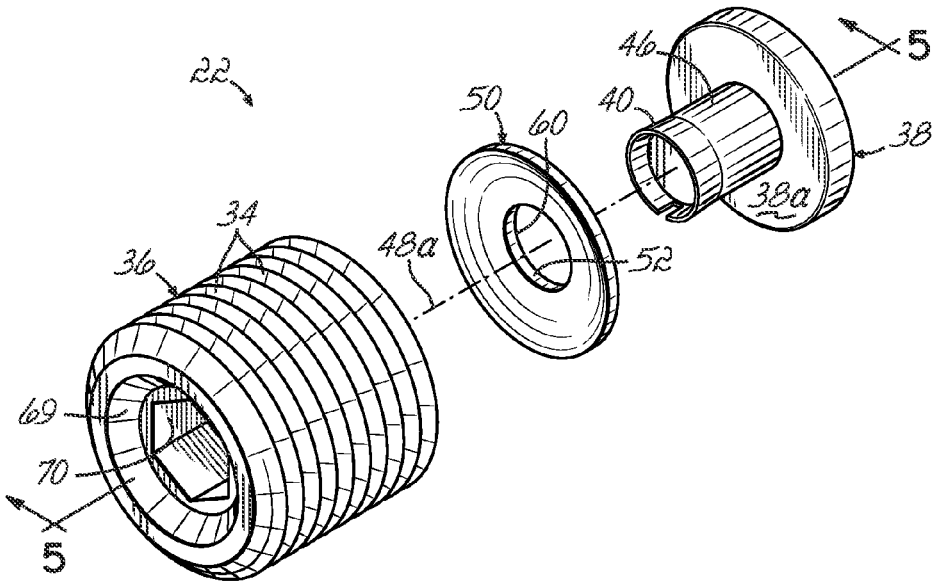
FIG. 4 is another disassembled perspective view of the screw assembly of FIGS. 2 and 3.

With reference to the drawings and, more particularly to FIG. 1, a connector 10 according to one embodiment of this invention includes a connector body 12 that is adapted to receive one or more conductors 14. To that end, the connector body 12 includes a lateral aperture 16 that permits introduction of the conductor 14 into and/or through the body 12. The body 12 includes a bore 18 having an axis 18*a*, extending from a top surface 19 of the body 12, and which is defined by a threaded wall 20 for receiving a screw assembly 22 to be described in further detail below. In this exemplary embodiment, the body 12 has a generally square cross section, although persons of ordinary skill in the art will readily appreciate that other shapes are similarly contemplated. The body 12 may further include an extending portion (not shown) which permits coupling of the body 12 with other components. To that end, the extending portion may include a secondary aperture to facilitate such coupling. Moreover, while only one bore 18 is shown, any number, configuration and arrangement of bores are within the scope of this invention.

As noted above, the body 12 is adapted to receive one or more conductors 14. More particularly, the body 12 of this exemplary embodiment includes a lateral aperture 16 that defines a lateral bore 26 extending through the body 12 in a direction generally transverse to the axis 18*a* of the bore 18. This transverse orientation of the lateral bore 26 permits, as explained below, securement of the conductor 14 within the body 12 via engagement of the screw assembly 22. The lateral bore 26 is suitably sized to receive a range of sizes of conductors 14. The conductor may be defined by multiple strands 14*a*. The lateral bore 26 therefore, is suitably sized to receive the strands 14*a* which may in some cases diverge in different directions. The lateral bore 26 moreover extends between opposed side walls 30 of the body 12.

With reference to FIGS. 1-6, the screw assembly 22 is a unitary structure and engages the body 12 of the connector 10 through engagement of the threaded wall 20 of the bore 18 with exterior threads 34 of the screw assembly 22. More particularly, the screw assembly 22 engages the body 12 of the connector 10 in such a way that the screw assembly 22 is releasably coupled to the body 12. The screw assembly 22 includes a threaded body 36 and a T-shaped contact plate 38 that is rotationally coupled to the threaded body 36 and free to rotate relative to the body 36. Rotational coupling of the contact plate 38 is facilitated by press fitting or the like of an end portion 40 of a shank 46 coupled to the contact plate 38 within a bore 48 of the threaded body 36.

The contact plate 38 is spaced from the threaded body 36 in the assembled, unitary configuration of the screw assembly 22. In particular, the space between the contact plate 38 and the threaded body 36 is defined by a distance between the contact plate 38 and a point of coupling between the end portion 40 of the shank 46 within the bore 48 of the threaded body 36. This space, along with the coupling of the shank 46 within the bore 48 enable rotational movement of the contact plate 38 relative to the threaded body 36, even when the screw assembly 22 is coupled to the body 12 of the connector 10. A spacer 50, which in this exemplary embodiment takes the form of a cup spring washer (i.e., a Belleville washer), is positioned between the threaded body 36 and the contact plate 38. In this regard, the cup spring washer 50 includes an aperture 52 that is configured to receive the shank 46. When the threaded body contact plate 38, and the cup spring washer 50 are coupled to one another, the screw assembly 22 defines a unitary structure that is engageable with the body 12 of the connector 10. As such, even though the screw assembly 22 includes a number of discrete components, those components, when assembled, are not intended to be disassembled. Therefore, the screw assembly 22 is usable in the field without the need for any disassembly or assembly.

Figure 5:
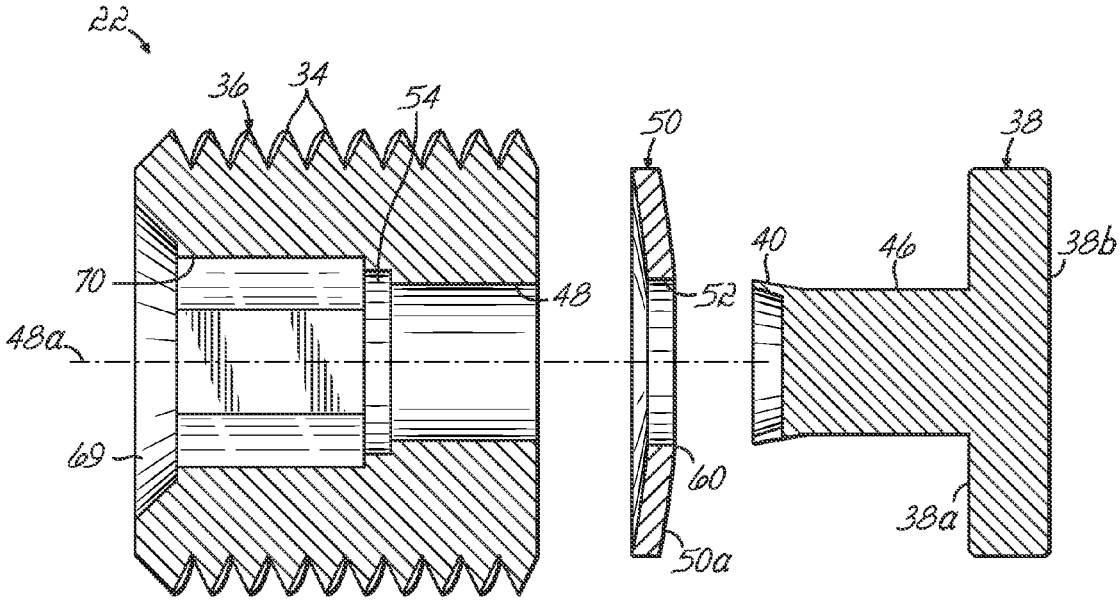
FIG. 5 is a cross-sectional view taken generally along lines 5-5 of FIG. 4.
Figure 6:
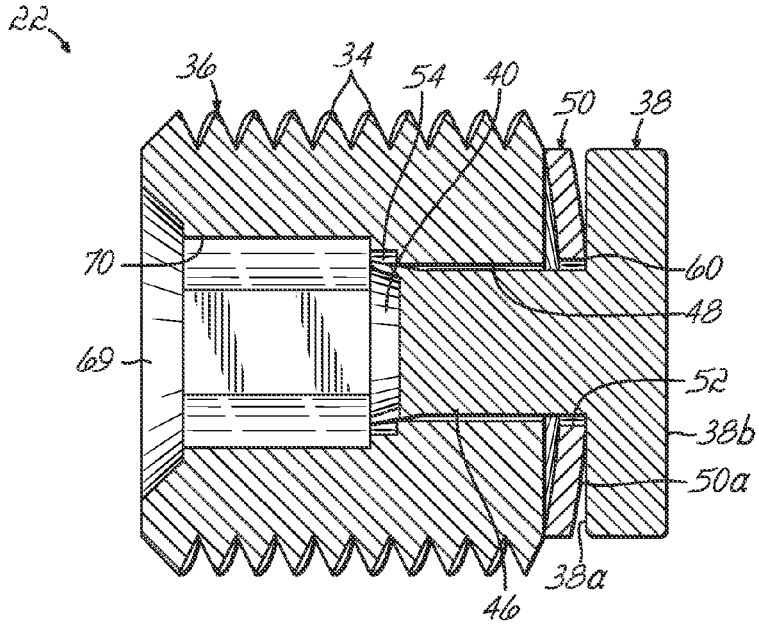
FIG. 6 is an assembled cross-sectional view of the screw assembly of FIG. 5.

Coupling of the shank 46 within the bore 28 of the threaded body 36 also restricts movement of the contact plate 38 relative to the threaded body 36, such that the contact plate 38 cannot be separated from the threaded body 36. Moreover, this coupling permits movement of the contact plate 38 toward the threaded body 36. With particular reference to FIGS. 5-6, the amount of movement permitted by this coupling is defined by a spacing between the cup spring washer 50 and a top surface 38*a* of contact plate 38. The amount of movement is further defined by the particular type of coupling between the end portion 40 of shank 46 and a corresponding receiving structure 54 within the bore 48 of the threaded body 36.

Axial movement of the contact plate 38 relative to the threaded body 36 is limited by the cup spring washer 50. More particularly, the cup spring washer 50 has a projecting surface 50*a* that faces the contact plate 38 and which is deflectable in a direction along an axis 48*a* of the bore 48 of the threaded body 36. In this regard, a force exerted between the conductor 14 and a contact surface 38*b* of the contact plate 38 in a direction along the axis 48*a* deflects the cup spring washer 50 such that the projecting surface 50*a* is pushed toward the threaded body 36. This deflection, in turn, permits movement of the contact plate 38 toward the threaded body 36. Resiliency of the cup spring washer 50 exerts a reaction force against the contact plate 38 in a direction toward the conductor 14, thereby securing contact between the contact plate 38 and the conductor 14. Therefore, the cup spring washer 50 serves as a thrust washer between the plate 38 and screw body 36 for increased clamping force, torque retention and dynamic connection.

Rotational movement of the contact plate 38 relative to the threaded body 36 is enabled by minimizing the amount of contact between the contact plate 38 and the cup spring washer 50. More particularly, when the threaded body 36, cup spring washer 50, and contact plate 38 are coupled to one another, the contact plate 38 contacts the cup spring washer 50 only along a rim 60 defining aperture 52 of the cup spring washer 50, rather than along the entire projecting surface 50*a*. This minimum amount of contact between the contact plate 38 and the cup spring washer 50 in turn minimizes the friction between the contact plate 38 and the projecting surface 50*a*, thereby facilitating rotational movement of the contact plate 38 relative to the cup spring washer 50. No particular orientation of the contact plate 38 is required with the connector 10 of this invention.

The contact surface 38*b* is suitably shaped to minimize damage to conductor 14 engaged by the contact plate 38. More particularly, the contact surface 38*b* in some embodiments is in the form of a smooth or flat surface, thereby spreading the force exerted by the screw assembly 22 against the conductor 14 throughout the entire area of the contact surface 38*b*. Alternative embodiments of the contact plate 38*c*-38*l* are shown in FIGS. 8-17 each of which incorporate at least some of the features of the contact plate 38 shown in FIGS. 1-7. Those of ordinary skill will readily appreciate other contact plate designs within the scope of this invention in addition to those disclosed herein.

Figure 7:
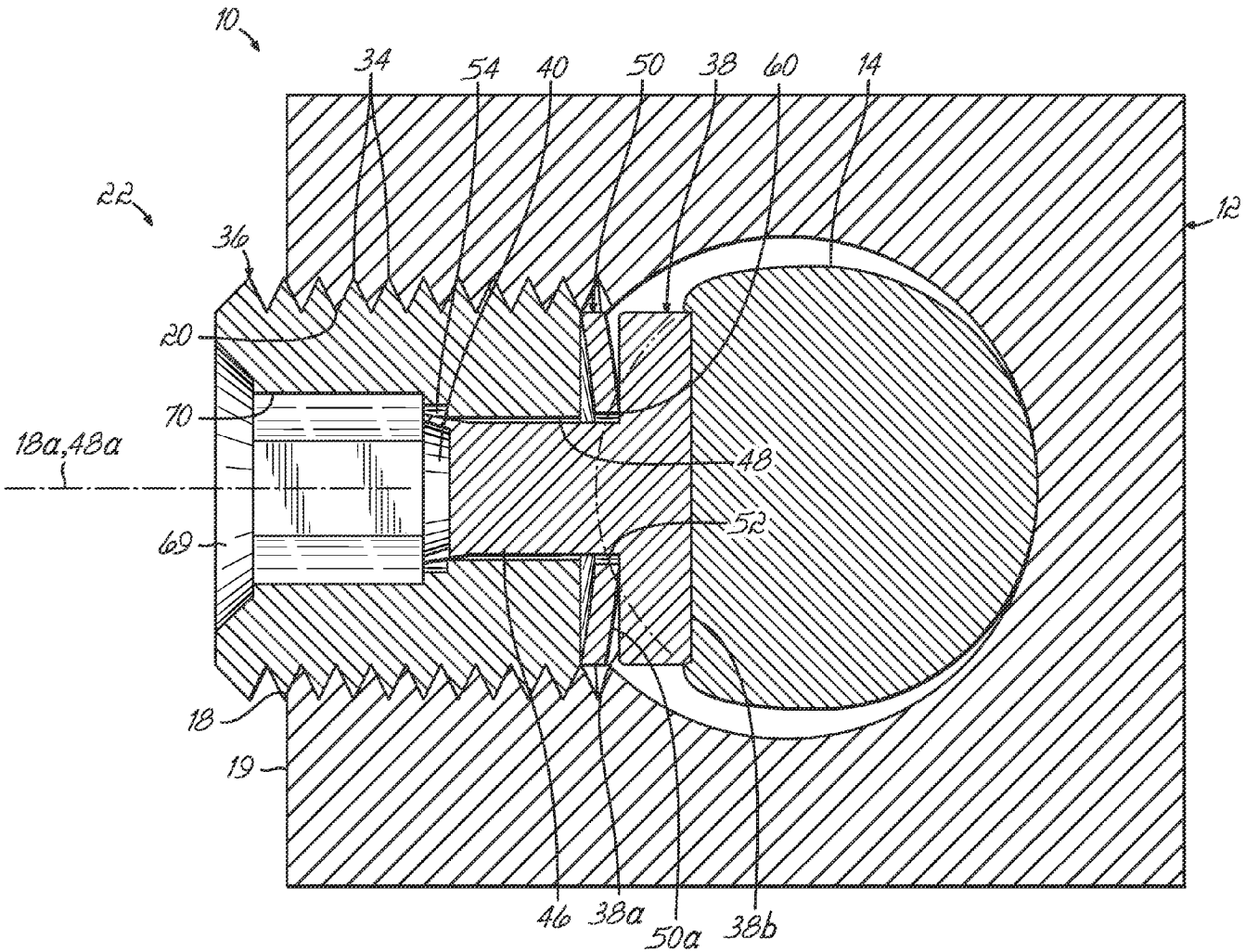
FIG. 7 is a cross-sectional view of the connector and screw assembly of FIG. 1 contacting a conductor.
Figure 8:
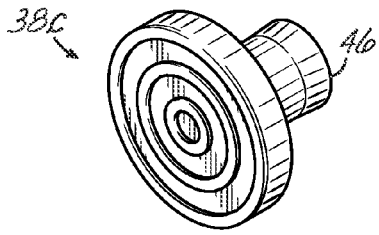
FIGS. 8-17 are perspective views of alternative embodiments of a plate of the screw assembly according to this invention.
Figure 9:
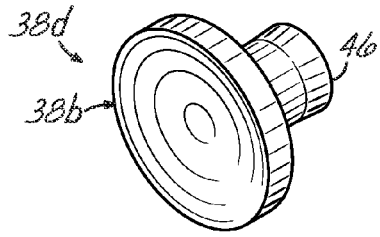
Figure 10:
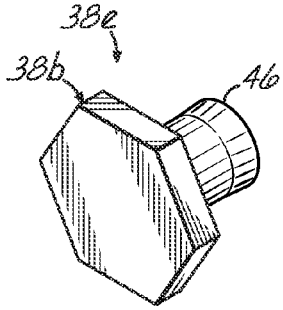
Figure 11:
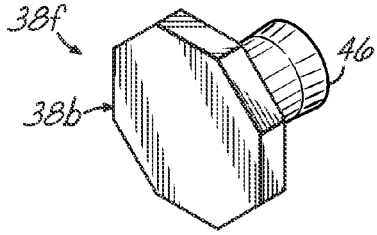
Figure 12:
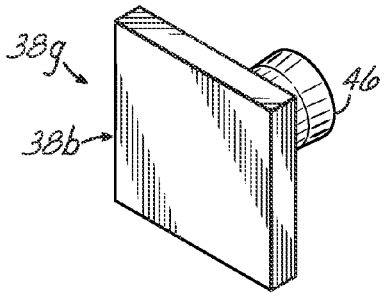
Figure 13:
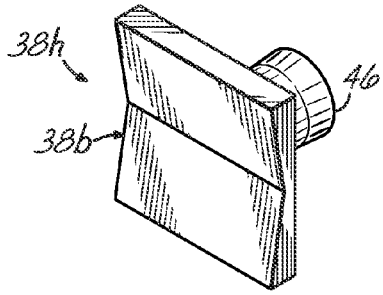
Figure 14:
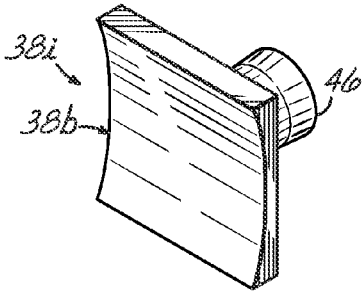
Figure 15:
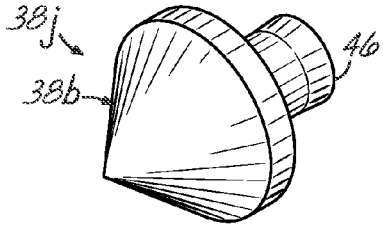
Figure 16:
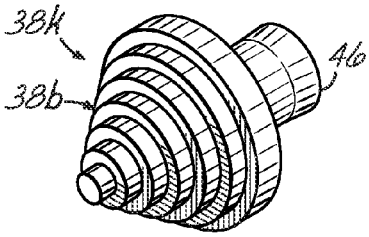
Figure 17:
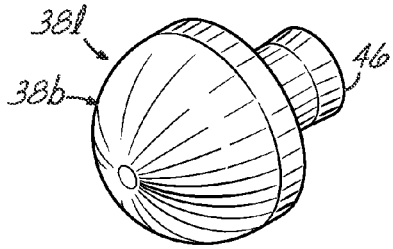

The operation of the screw assembly 22 is best appreciated with respect to the structure depicted in FIG. 7. The screw assembly 22 is inserted into the body 12 of the connector 10 by engaging the exterior threads 34 of the threaded body 36 with the threaded wall 20 in the bore 18 of the connector body 12. Moreover, lip 69 is disposed at a proximal end of the bore 18 to facilitate initial engagement of the threaded body 12 with the threaded wall 20. In this regard, rotation of the threaded body 36 relative to the body 12 is facilitated by engagement of a tool (not shown) that engages a tool engaging portion at a proximal end of the threaded body 36. In this exemplary embodiment, the tool engaging portion is in the form of a socket 70 configured to accept an Allen wrench. Persons of ordinary skill in the art however, will readily appreciate that other types of tool engaging portions may be substituted, such as portions configured to receive a different type of tool.

Rotation of the screw assembly 22 relative to the body 12 may be continued up to a point where deflection of the cup spring washer 50 is detected. This deflection, as noted above, causes a reaction force to be exerted by the cup spring washer 50 against the contact plate 38. This reaction force, in turn, causes a force to be exerted by the contact surface 38*b* of the contact plate 38 against the conductor 14 in the body 12 of the connector 10. This force exerted against the conductor 14 thereby secures the connector 10 to the conductor 14. Any subsequent expansion or contraction of the conductor 14 relative to the contact plate 38 does not result in decoupling of the screw assembly 22 relative to the body 12 of the connector 10. More particularly, any such expansion or contraction respectively causes a further deflection of the cup spring washer 50 or a return thereof to its original shape. Accordingly, the position of the threaded body 36 relative to the body 12 of the connector 10 is fixed regardless of any relative expansion or contraction of the conductor 14. Likewise, any vibration of a structure containing the connector 10 will result in the conductor 14 exerting a force against the contact plate 38 which, in turn, exerts a force against the cup spring washer 50 which will react accordingly by deflecting or returning to its original shape rather than decoupling the threaded body 36 from the body 12 of the connector 10.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

What is claimed is:

1. An electrical connecting assembly for securing a conductor, comprising:

a connector body configured to receive the conductor therein; and a unitary structure including a threaded body and a contacting structure, said threaded body being coupled to a coupling portion of said connector body, said contacting structure including a plate spaced from said threaded body and having a flat contacting surface configured for contacting the conductor, said plate being coupled to said threaded body such that said plate is rotatable relative to said threaded body when said threaded body is coupled to said coupling portion, said plate being restricted from movement away from said threaded body when said threaded body is not coupled to said coupling portion.

2. The electrical connecting assembly of claim 1, wherein said unitary structure further comprises a spacer urging said plate away from said threaded body.

3. The electrical connecting assembly of claim 2, wherein said spacer is configured to deflect toward said threaded body where said plate contacts the conductor.

4. The electrical connecting assembly of claim 2, wherein said plate is rotatable relative to said spacer.

5. The electrical connecting assembly of claim 1, wherein said plate is configured for movement toward said threaded body.

6. The electrical connecting assembly of claim 2 wherein said plate is rotatable relative to said spacer and said threaded body.

7. An electrical connecting assembly for securing a conductor, comprising:

a connector body configured to receive the connector therein and having a threaded bore; and a unitary structure including a threaded body and a contacting structure, said threaded body being releasably coupled to said connector body within said threaded bore, said contacting structure including a shank and a plate coupled to a first end of said shank, said plate being spaced from said threaded body and having a smooth contacting surface configured for contacting the conductor, said shank having a second end coupled to said threaded body within said bore such that said plate is rotatable relative to said threaded body when said threaded body, said plate being restricted from movement away from said threaded body.

8. A screw assembly for use with an electrical connector for securing a conductor, comprising:

a threaded body configured to be coupled to a coupling portion of the connector; and a plate spaced from said threaded body and having a flat contacting surface configured for contacting the conductor, said plate being coupled to said threaded body and rotatable relative to said threaded body when the threaded body is coupled to said coupling portion of the connector, and said plate is restricted from movement away from said threaded body when said threaded body is not coupled to said coupling portion of the connector.

9. The screw assembly of claim 8, further comprising:

a spacer positioned between said plate and said threaded body and configured to urge said plate away from said threaded body.

10. The screw assembly of claim 9, wherein said spacer is configured to deflect toward said threaded body, when said plate contacts the conductor.

11. The screw assembly of claim 9, wherein said plate is rotatable relative to said spacer.

12. The screw assembly of claim 8, wherein said spacer is rotatable relative to said plate and said threaded body.

13. The screw assembly of claim 8, wherein said plate and said threaded body define a unitary structure configured to be releasably coupled to the connector.

14. A screw assembly for use with an electrical connector for securing a conductor, comprising:

a threaded body having a bore configured to be coupled within a threaded bore of the connector;

a shank coupled within the bore of said threaded body;

a plate coupled to said shank, said plate being spaced from said threaded body and having a smooth and flat contacting surface configured for contacting the conductor; and a spacer positioned between said plate and said threaded body and configured to urge said plate away from said threaded body;

wherein said plate is rotatable relative to said threaded body when said threaded body is coupled within the bore of the connector, and said plate is restricted from movement away from said threaded body when said threaded body is not coupled within the bore of the connector.

15. The screw assembly of claim 14, wherein said spacer is configured to deflect toward said threaded body, when said plate contacts the conductor.

16. The screw assembly of claim 14, wherein said plate is rotatable relative to said spacer.

17. The screw assembly of claim 14, wherein said spacer is rotatable relative to said plate and said threaded body.

18. The screw assembly of claim 14, wherein said threaded body, said plate and said spacer jointly define a unitary structure being releasably coupled to the connector.

19. A method of securing a conductor to a connector, comprising:

positioning the conductor within the connector;

releasably coupling a first portion of a unitary structure with a coupling portion of the connector;

engaging a second portion of the unitary structure with the conductor, the first and second portions being spaced from one another; and rotating the second portion of the unitary structure relative to the first portion after the engaging step.

20. The method of claim 19, further comprising:

deflecting the second portion toward the first portion, wherein the second portion contacts the conductor.

* * * * *